United States Patent [19]

Tamagawa et al.

[11] Patent Number: 4,682,191

[45] Date of Patent: Jul. 21, 1987

[54] HEAT-SENSITIVE RECORDING PAPER

[75] Inventors: Shigehisa Tamagawa; Tetsuro Fuchizawa, both of Shizuoka, Japan

[73] Assignee: Fuji Photo Film Co., Ltd., Kanagawa, Japan

[21] Appl. No.: 826,466

[22] Filed: Feb. 5, 1986

[30] Foreign Application Priority Data

Feb. 5, 1985 [JP] Japan ..... 60-20251

[51] Int. Cl.[4] ..... B41M 5/18

[52] U.S. Cl. ..... 503/200; 503/207; 503/226; 427/150; 427/151; 427/152; 428/207; 428/211; 428/537.5

[58] Field of Search ..... 346/200, 207, 226; 427/150–152; 428/195, 207, 211, 341, 342, 913, 914, 537.5

[56] References Cited

U.S. PATENT DOCUMENTS 4,333,984 6/1982 Igarashi et al. ..... 428/537.5

FOREIGN PATENT DOCUMENTS 0051385 5/1981 Japan ..... 346/200
0115292 9/1981 Japan ..... 346/200
0002794 1/1982 Japan ..... 346/200
0091296 6/1982 Japan ..... 346/200
0069091 4/1983 Japan ..... 346/200

*Primary Examiner*—Bruce H. Hess
*Attorney, Agent, or Firm*—Sughrue, Mion, Zinn, Macpeak, and Seas

[57] ABSTRACT

A heat-sensitive recording paper is described, comprising a paper support having thereon a heat-sensitive color forming layer, wherein said paper support contains at least 10% by weight of a pigment and has an internal bonding strength as defined by Tappi-RC-308 of from 0.5 to 2.5 kg.cm.

14 Claims, No Drawings

HEAT-SENSITIVE RECORDING PAPER

FIELD OF THE INVENTION

This invention relates to a heat-sensitive recording paper for conducting recording by a thermal head of a thermal pen. More particularly, the invention relates to a heat-sensitive recording paper which causes neither sticking between a thermal head and the heat-sensitive color forming layer thereof nor piling on a thermal head, and gives clear and high density recording with good dot reproducibility even in high speed recording.

BACKGROUND OF THE INVENTION

Recently, facsimile equipment, printers, etc., have become remarkably developed, and heat-sensitive recording system comprising a combination of, for example, a heat-sensitive recording paper having a heat-sensitive color forming layer containing a colorless dye such as Crystal Violet lactone and a phenol compound and a thermal head as described, for instance, in Japanese Patent Publication No. 14039/70 (corresponding to British Patent Publication No. 1,135,54A), etc., is widely employed for such apparatus.

The heat-sensitive recording system has many advantages, such as that the recording paper is of primary coloring, the system does not require liquid development, the recording apparatus can be simplified, the costs for recording papers, recording apparatus, etc., are low, recording is performed by a non-impact technique without generating noise, etc., and hence this system has gained a steadfast position as a low speed recording system. However, a significant disadvantage of the heat-sensitive recording system is that the recording speed is lower than those of other recording systems, such as electrostatic recording, and hence the recording system has not yet been employed in high speed recording.

The main reason that the aforesaid heat-sensitive recording system has not been applicable for high speed recording in heat-sensitive recording is that the heat transfer between a thermal head and a heat-sensitive recording paper which is brought into contact with the thermal head is insufficient, whereby a sufficient recording density is not obtained.

A thermal head composed of an assembly of dot form electron resistance heating elements generates heat by recording signals to melt and color a heat-sensitive color forming layer in contact with the thermal head. In this system, for obtaining clear and high density recording, it is required that the dot reproducibility is good, that is, it is required that a thermal head is brought into contact with a heat-sensitive color forming layer as closely as possible in order to efficiently conduct heat transfer and form completely colored dots corresponding to the form of the dot heating elements of the thermal head at high speed. However, at present, only a few percent of the amount of heat generated at the thermal head is transferred to the heat-sensitive color forming layer, and hence the heat transfer efficiency is very low.

Various methods for improving the smoothness of a heat-sensitive color forming layer for bringing a heat-sensitive color forming layer into contact with a thermal head as closely as possible have been proposed.

For example, Japanese Patent Publication No. 20142/77 describes that the surface of a heat-sensitive color forming layer is treated to provide a surface smoothness of from 200 to 1,000 sec. in Beck smoothness. Japanese Patent Application (OPI) No. 115255/79 (the term "OPI" as used herein refers to a "published unexamined Japanese patent application") describes that the heat-sensitive color forming layer having a surface smoothness of from 200 to 1,000 sec. in Beck smoothness can respond only to a heat pulse of as short as about 5 or 6 milliseconds and for performing high speed recording of shorter than 1 milli-second, it is necessary that the surface of a heat-sensitive color forming layer is treated to provide a surface smoothness of higher than 1,100 sec. in Beck smoothness. However, if the surface of a heat-sensitive color forming layer is smoothed to higher than 1,100 sec. in Beck smoothness, colored fog is formed due to pressure. The formation of colored fog is prevented by previously improving the smoothness of the surface of a base paper for a heat-sensitive recording paper to higher than 500 sec. in Beck smoothness. Futhermore, Japanese Patent Application (OPI) No. 156086/78 describes that the surface roughness Ra of the surface of a heat-sensitive color forming layer is reduced to lower than 1.2 $\mu$m and the glossiness thereof is reduced to lower than 25% of its original value.

In the above described conventional techniques for improving the smoothness of heat-sensitive color forming layers of heat-sensitive recording papers, the smoothness of the heat-sensitive color forming layer is improved by a calender treatment simply using a super-calender, a machine calender, a gloss calender, etc. the calender treatment is applied to a base paper only or to a base paper and the heat-sensitive paper using the base paper, or to a heat-sensitive paper only. In this case, however, in the heat-sensitive paper the smoothness of the surface of which is improved by the calender treatment, with the improvement of recording density by the increase of the smoothness, the occurrence of sticking, piling, etc., of the heat-sensitive paper on a thermal head is increased, and hence the smoothness thereof is, in reality, controlled to a proper level to properly balance the recording density with the sticking or piling tendencies. Such conventional techniques cannot practically be applied for high speed recording in point of recording density or recording stability to reduce the sticking and piling regardless of the selection of the smoothness level.

Sticking is a phenomenon in which a heat-sensitive color forming layer of the heat-sensitive recording paper sticks to a thermal head during recording to generate peeling sound and/or reduce tthe dot reproducibility, and piling is a phenomenon in which the heat melt of a heat-sensitive color forming layer is piled on a thermal head to reduce recording density and dot reproducibility. Both of these phenomena disturb stable recording in heat-sensitive recording systems.

Also, another demerit of the calender treatement for a heat-sensitive paper is that the heat-sensitive paper forms colored fog due to pressure, to thereby cause a high density in the background portions of the heat-sensitive recording paper. On the other hand, at present, there is a limit about a calender treatment onto a base paper owing to the formation of cockle, wrinkles, etc., caused by uneven basis weight of the heat-sensitive recording layer.

As described above, there remain limits on the smoothing of a heat-sensitive color forming layer and the increase of recording density that is possible by a calender treatment. Thus, a sufficiently satisfactory heat-sensitive recording paper for high speed recording has not yet been obtained by the application of a calender treatment.

SUMMARY OF THE INVENTION

The object of this invention is to provide a heat-sensitive recording paper capable of overcoming the above described disadvantages of the conventional techniques, and thus providing a heat-sensitive recording paper giving good dot reproducibility and high recording density.

As a result of extensive investigations for overcoming the above described disadvantages in conventional techniques, the inventors have discovered that the above described object of this invention can be attained by providing a heat-sensitive color forming layer on a paper support containing at least 10% by weight pigment(s) and having the internal bonding strength defined by Tappi RC-308 (i.e., Tappi Useful Method-528) of from 0.5 to 2.5 *kg.cm.* That is, the heat-sensitive recording paper of this invention composed of the above described paper support having thereon a heat-sensitive color forming layer gives an increased contact efficiency with a thermal head and gives good dot reproducibility and high recording density.

DETAILED DESCRIPTION OF THE INVENTION

The invention is described below in further detail.

The paper support for use in this invention contains at least 10% by weight pigment(s). Preferred pigments are white inorganic pigments such as talc, clay, kaolin, baked kaolin, natural silica, synthetic silica, barium sulfate, titanium oxide, etc., and white organic pigments such as a urea-formaldehyde resin, a polystyrene resin, a polyethylene resin, an acrylic resin, etc. The average particle size (diameter) of these pigments is preferably from 0.1 to 10 $\mu$m. It is necessary that the content of the pigment in the paper support is 10% by weight or more, preferably 10 to 30% by weight, more preferably 10 to 20% by weight, based on the amount of the paper support. If the content of the pigment is less than the aforesaid amount, a sufficient effect thereof is not obtained.

The paper support for use in this invention has the internal bonding strength defined by Tappi-RC-308 of from 0.5 to 2.5 kg.cm. As practical manners of obtaining the internal bonding strength of the paper support, there are the addition of the aforesaid pigment as well as the selections of a pulp, a sizing agent, a softening agent, a paper strength increasing agent, etc., and the selections of the conditions of beating of pulp, wet pressing, dry, etc., of paper.

When the internal bonding strength is 2.5 kg.cm or less, high recording density is obtained, but if the internal bonding strength is less than 0.5 kg.cm, cutting etc., of paper occurs during manufacturing the paper and also the heat-sensitive recording paper using the paper support becomes poor stiffness. The internal bonding strength is more preferably from 1.0 to 2.0 kg.cm. Also, for increasing the effect of this invention, it is preferred to increase the density of the base paper to 0.80 g/cm$^3$ or more, and more preferably 0.83 g/cm$^3$ or more. The upper limit of the density of the base paper is preferably 1.0 g/cm$^3$.

furthermore, for preventing the reduction in the surface smoothness at coating a heat-sensitive coating composition on the paper support, it is preferred that the Cobb-water absorption degree of the paper support defined by JIS-P-8140 is 25 g/m$^2$ or less, more preferably 20 g/m$^2$ or less.

The paper support for use in this invention is preferably produced using mainly a wood pulp, but may be produced using a mixture of wood pulp and synthetic fibers or a synthetic pulp. As a wood pulp, a needle-leaved tree pulp or a broadleaf tree pulp can be used, but the use of a broadleaf tree pulp of short fibers capable of easily providing a smooth surface is preferred. The freeness of the pulp for use in this invention is preferably from 200 to 500 c.c. (C.S.F., Canadian Standard Freeness), and more preferably from 300 to 400 c.c.

The pulp composition may contain, in addition to the above described pigment, a sizing agent such as rosin, paraffin wax, a higher fatty acid salt, an alkenyl succinate, an aliphatic anhydride, a styrenemaleic anhydride copolymer, an alkylketene dimer, an epoxylated fatty acid amide, etc.; a softening agent such as a reaction product of a maleic anhydride copolymer and a polyalkylenepolyamine, a quaternary ammonium salt of a higher fatty acid, etc.; a paper strength increasing agent such as polyacrylamide, starch, polyvinyl alcohol, a melamine-formaldehyde condensation product, gelatin, etc.; and a fixing agent such as aluminum sulfate, polyamidopolyamine epichlorohydrin, etc. Futhermore, if desired, the pulp composition may further contain a dye, a fluorescent dye, an antistatic agent, etc.

A heat-sensitive coating composition for use in this invention is explained below.

A color former and a developer each is separately dispersed in each aqueous solution of a water-soluble polymer using a means such as a ball mill, etc. For finely dispersing the color former or the developer in, for example, a ball mill, balls having different particle sizes are used in a proper mixing ratio and each component in the aforesaid solution is dispersed thereby for a sufficient period of time. Also, the use of a model sand mill (Dyno mill), etc., is effective for the above described purpose.

The dispersion of the color former and the dispersion of the developer thus obtained are mixed with each other and then an inorganic pigment, a wax, a higher fatty acid amide, a metal soap, and, if desired, an ultraviolet absorbent, an antioxidant, a latex series binder, etc., are added to the mixture to provide the heat-sensitive coating composition. These additives may be added to the above described aqueous dispersion at dispersing the color former or the developer.

The heat-sensitive coating composition is coated on the paper support at a color former coverage of from 0.2 to 1.0 g/m$^2$.

Color formers which are used for general pressure-sensitive recording papers, heat-sensitive recording papers, etc., can be used as the color former in this invention without any particular restriction.

Specific examples of color formers include (1)triarylmethane series compounds such as 3,3-bis(p-dimethylaminophenyl)-6-dimethylaminophthalide (i.e., Crystal Violet lactone), 3-(p-dimethylaminophenyl)-3-(1,2-dimethylindol-3-yl)phthalide, 3-(p-dimethylaminophenyl)-3-(2-phenylindol-3-yl)phathalide, 3,3-bis(p-ethylcarbazol-3-yl)-3-dimethylaminophthalide, 3,3-bis-(2-phenylindol-3-yl)-5-dimethylaminophthalide, etc.; (2) diphenylmethane series compounds such as 4,4-bis-dimethylaminobenzhydrinbenzyl ether, N-halophenyl leucoauramine, N-2,4,5-trichlorophenyl leucoauramine, etc.; (3) xanthene series compounds such as Rhodamine B-anilinolactam, 3-diethylamino-7-dibenzylaminofluoran, 3-diethylamino-7-butylaminofluoran, 3-diethylamino-7-(2-chloroanilino)fluoran, 3-diethylamino-6-methyl-7-anilinofluoran, 3-piperidino-6-methyl-7-anilinofluoran, 3-ethyltriamino-6-methyl-7-anilinofluoran, 3-cyclohexylmethylamino-6-methyl-7-anilinofluoran, 3-diethylamino-6 -chloro-7-(β-ethoxyethyl)aminofluoran, 3-diethylamino-6-chloro-7-(γ-chloropropyl-)aminofluoran, 3-diethylamino-6-chloro-7-anilinofluoran, 3-N-cyclohexyl-N-methylamino-6-methyl-7-anilinofluoran, 3-diethylamino-7-phenylfluoran, etc.; (4) thiadine series compounds such as benzoyl leucomethylene blue, p-nitrobenzoyl leucomethylene blue, etc.; and (5) spiro series compounds such as 3-methylspiro-dinaphthopyran, 3-ethyl-spiro-dinaphthopyran, 3-benzyl-spiro-dinaphthopyran, 3-methylnaphtho-(3-methoxybenzo)-spiropyran, etc. They can be used singly or as a mixture thereof and are selected according to the intended use and the desired characteristics.

As the developer for use in this invention, phenol derivatives and aromatic carboxylic acid derivatives are preferably used and bisphenols are particularly preferred. Specific examples of phenols include p-octylphenol, p-tert-butylphenol, p-phenylphenol, 2,2-bis(p-hydroxy)propane, 1,1-bis(p-hydroxyphenyl)pentane, 1,1-bis(p-hydroxyphenyl)hexane, 2,2-bis(p-hydroxphenyl)-hexane, 1,1-bis(p-hydroxyphenyl)-2-ethylhexane, 2,2-bis(4-hydroxy-3,5-dichlorophenyl)propane, etc.

Also, specific examples of the aromatic carboxylic acid derivatives include p-hydroxybenzoic acid, propyl p-hydroxybenzoate, butyl p-hydroxybenzoate, benzyl p-hydroxybenzoate, 3,5-di-α-methylbenzylsalicylic acid or polyvalent metal salts of said carboxylic acids, etc. The zinc salts thereof are preferred.

It is preferred that the developer is added to the above described aqueous solution of a water-soluble polymer or binder as an eutectic mixture with a low melting heat-meltable material or as a state that a low melting compound is fused onto the surfaces of the developer particles for melting the developer and causing a coloring reaction at a desired temperature.

Examples of waxes which can be used for the heat-sensitive recording papers of this invention include paraffin wax, carnauba wax, microcrystalline wax, polyethylene wax, and higher fatty acid amides such as stearic acid amide, ethylene-bisstearoamide, higher fatty acid exters, etc.

Examples of metal soap which can be used in this invention include polyvalent metal salts of higher fatty acids, such as zinc stearate, aluminum stearate, calcium stearate, zinc oleate, etc.

Examples of inorganic pigments which can be used in this invention include kaolin, baked kaolin, talc, roselite, diatomaceous earth, calcium carbonate, aluminum hydroxide, magnesium hydroxide, magnesium, carbonate, titanium oxide, barium carbonate, etc.

It is preferred that the oil absorptiveness of the inorganic pigment is 60 ml/100 g or more and the average particle size thereof is 5 μm or less. It is preferred that an oil absorptive inorganic pigment exists in the heat-sensitive recording layer in a dry weight of from 5 to 50% by weight, and particularly preferably from 10 to 40% by weight.

The above described components are coated on the paper support described above as a dispersion in a binder.

As the binder, a water-soluble binder is generally used. Specific examples of the binder are polyvinyl alcohol, hydroxyethyl cellulose, hydroxypropyl cellulose, and ethylene-maleic anhydride copolymer, a styrene-maleic anhydride copolymer, an isobutylenemaleic anhydride copolymer, polyacrylic acid, starch derivatives, casein, gelatin, etc.

Also, for imparting water resistance to the binder, a water resistance imparting agent (e.g., a gelling agent, a crosslinking agent, etc.) may be added to the binder, or an emulsion of a hydrophobic polymer, such as a styrene-butadiene rubber latex, an acrylic resin emulsion, etc., may be added thereto.

The binder is incorporated in the heat-sensitive recording layer in a dry weight of from 10 to 30% by weight. Furthermore, if desired, various assistants such as a defoaming agent, a fluorescent dye, a coloring dye, etc., may be properly added to the coating composition.

The heat-sensitive coating composition described above can be coated using a conventional coating method such as a blade coating method, an air knife coating method, a gravure coating method, a roll coating method, a spray coating method, a dip coating method, a bar coating method, and extrusion coating method, etc.

There is no particular restriction on the coating amount of the heat-sensitive coating composition for forming the heat-sensitive recording layer, but the amount is generally in the range of from 3 to 15 g/m$^2$, and preferably form 4 to 10 g/m$^2$ by dry weight.

The following examples are intended to illustrate the present invention, but not limit it in any way. Unless otherwise indicated in the following examples, all parts and percents are by weight.

EXAMPLE 1

After beating 100 parts of LBKP ((Laubholz) Bleeched Kraft Pulp) to a Canadian freeness of 350 cc, 1.0 part of rosin, 1.5 parts of aluminum sulfate, and talc (in the amount shown in Table 1 below as the content in paper) were added to the pulp and a base paper of 50 g/m$^2$ in base weight using the pulp composition thus obtained by means of a Fourdrinier paper machine. thereafter, the thickness of the base paper was controlled by a supercalender so that the density thereof became the value shown in Table 1. The properties of the base papers thus prepared are shown in Table 1.

TABLE 1

| Sample No. | Content of Pigment | Density | Internal Bonding Strength | Cobb-Water Absorption Degree | Beck Smoothness |
|---|---|---|---|---|---|
| 1 | 10.2 | 0.84 | 2.3 | 21.2 | 101 |
| 2 | 12.1 | 0.83 | 1.9 | 22.0 | 108 |
| 3 | 14.5 | 0.86 | 1.7 | 22.3 | 210 |

EXAMPLE 2

After beating 70 parts of LBKP and 30 parts of NBKP ((Nadelholz) Bleeched Kraft Pulp ) to a Canadian freenes of 380 cc, 0.2 part of alkylketone dimer, 0.2 part of polyamidopolyamine epichlorohydrin, 0.2 part of epoxylated fatty acid amide, and calcium carbonate ($CaCO_3$) in the amount (as shown in Table 2 as the content in paper) were added to the pulp mixture and paper of 45 g/m$^2$ in base weight was manufactured using the aforesaid mixture by a fourdrinier paper machine. Then, the density thereof was controlled by a super-calender as in Example 1. The physical properties of the samples thus prepared are shown in Table 2.

TABLE 2

| Sample No. | Content of Pigment | Density | Internal Bonding Strength | Cobb-Water Absorption Degree | Beck Smoothness |
|---|---|---|---|---|---|
| 4 | 11.3 | 0.85 | 1.8 | 18.3 | 203 |
| 5 | 15.1 | 0.86 | 1.4 | 19.2 | 232 |

COMPARISON EXAMPLE 1

After beating 100 parts of LBKP to 250 cc in Canadian freeness, 0.5 part of rosin, 1.0 part of aluminum sulfate, and talc in an amount (as shown in Table 3 as the content in paper) were added thereto and a base paper of 50 g/m$^2$ was manufactured by means of a Fourdrinier paper machine and the density thereof was controlled as in Example 1. The physical properties of the samples thus prepared are shown in Table 3.

TABLE 3

| Sample No. | Content of Pigment | Density | Internal Bonding Strength | Cobb-Water Absorption Degree | Beck Smoothness |
|---|---|---|---|---|---|
| 6 | 0 | 0.75 | 3.3 | 30.7 | 43 |
| 7 | 6.3 | 0.80 | 2.8 | 31.5 | 75 |

COMPARISON EXAMPLE 2

After beating 70 parts of LBKP and 30 parts of NBKP to 300 cc in Canadian freeness, 0.2 part of alkylketene dimer, 0.2 part of polyamidopolyamine epichlorohydrin, and calcium oxide ($CaO_3$) in an amount (as shown in Table 4 as the content in paper) were added thereto and a base paper of 45 g/m$^2$ in base weight was manufactured by means of a Fourdrinier paper machine. The density was controlled as in Example 1. The physical properties of the samples thus prepared are shown in Table 4.

TABLE 4

| Sample No. | Content of Pigment | Density | Internal Bonding Strength | Cobb-Water Absorption Degree | Beck Smoothness |
|---|---|---|---|---|---|
| 8 | 2.1 | 0.81 | 2.9 | 27.3 | 95 |
| 9 | 7.8 | 0.77 | 2.3 | 28.1 | 69 |

As described above, nine samples of paper support in Examples of this invention (Sample Nos. 1 to 5) and Comparison Examples (Sample Nos. 6 to 9) and then a heat-sensitive composition as described hereinbelow was coated on each of the samples to provide heat-sensitive recording papers. The recording density was measured on each of the heat-sensitive recording papers and the results are shown in Table 5 below.

In addition, the production method and the coating method of the heat-sensitive coating composition and the measurement method of the recording density of the heat-sensitive recording paper employed are shown below.

Production of Heat-Sensitive Coating Composition

In a 300 liter ball mill was dispersed 20 kg of Crystal Violet lactone in an aqueous solution of 10% polyvinyl alcohol (a saponification degree of 98% and a polymerization degree of 500) for about 24 hours. Similarly, 20 kg of 2,2-bis(4-hydroxyphenyl)propane was dispersed in an aqueous solution of 10% polyvinyl alcohol in a 300 liter ball mill for about 24 hours. Both of the dispersions were mixed with each other so that the weight ratio of Crystal Violet lactone to 2,2-bis(4-hydroxyphenyl)propane became 1/5 by weight ratio and further 5 kg of precipitated calcium carbonate was added to 20 kg of the mixture and sufficiently dispersed therein to provide the heat-sensitive coating composition.

Coating Method of Heat-Sensitive Coating Composition

The coating composition was coated on one surface of the base paper by an air knife coater at a coverage of 6 g/m$^2$ as solid content, dried in a drier by a hot air blast at 50° C., and passed through a machine calender.

Measurement Method of Recording Density

Solid black-like coloring was performed at a recording speed of 2 milli-seconds per dot, a recording density of 5 dots/mm in the main scanning direction and 6 dots/mm in a side scanning direction, and a thermal head energy of 50 milli-joules/mm$^2$. The measurement of the recording density was performed by measuring the reflection density at 610 nm.

TABLE 5

| Sample No. | Coloring Density | Reproducibility of Dot |
|---|---|---|
| Sample 1 | 1.04 | Good |
| Sample 2 | 1.08 | Good |
| Sample 3 | 1.11 | Excellent |
| Sample 4 | 1.10 | Excellent |
| Sample 5 | 1.13 | Excellent |
| Comparison Sample 6 | 0.78 | Impossible |
| Comparison Sample 7 | 0.87 | Possible |
| Comparison Sample 8 | 0.86 | Possible |
| Comparison Sample 9 | 0.91 | Possible |

From the results shown above, it can be seen that the heat-sensitive recording papers of this invention are excellent in coloring density and dot reproducibility.

As described above, the heat-sensitive recording paper of this invention using the paper support containing 10% by weight or more of a pigment and having an internal bonding strength of 0.5 to 2.5 kg.cm provides effects such as increased contact area between the heat-sensitive color forming layer and a thermal head during recording, and thus provides high recording density and good dot reproducibility.

While the invention has been described in detail and with reference to specific embodiments thereof, it will be apparent to one skilled in the art that various changes and modifications can be made therein without departing from the spirit and scope thereof.

What is claimed is:

1. A heat-sensitive recording paper comprising a paper support having thereon a heat-sensitive color forming layer, wherein said paper support contains at least 10% by weight of a pigment and has an internal bonding strength as defined by Tappi-RC-308 of from 0.5 to 2.5 kg.cm.

2. A heat-sensitive recording paper as in claim 1, wherein the paper support has a density of at least 0.80 g/cm$^3$.

3. A heat-sensitive recording paper as in claim 1, wherein the pigment is a white inorganic pigment or a white organic pigment.

4. A heat-sensitive recording paper as in claim 3, wherein the pigment is a white inorganic pigment selected from the group consisting of talc, clay, kaolin, baked kaolin, natural silica, synthetic silica, barium sulfate, and titanium oxide, or a white organic pigment selected from the goup consisting of a ureaformaldehyde resin, a polystyrene resin, a polyethylene resin, and an acrylic resin.

5. A heat-sensitive recording paper as in claim 1, wherein the pigment has an average particle size of from 0.1 to 10 μm.

6. A heat-sensitive recording paper as in claim 1, wherein the paper support has a density of 0.83 g/cm$^3$ or more.

7. A heat-sensitive recording paper as in claim 1, wherein the internal bonding strength as defined by Tappi-RC-308 is from 1.0 to 2.0 kg.cm.

8. A heat-sensitive recording paper as in claim 7, wherein the paper support has a density of at least 0.80 g/cm$^3$.

9. A heat-sensitive recording paper as in claim 7, wherein the pigment is a white inorganic pigment or a white organic pigment.

10. A heat-sensitive recording paper as in claim 9, wherein the pigment is a white inorganic pigment selected from the group consisting of talc, clay, kaolin, baked kaolin, natural silica, synthetic silica, barium sulfate, and titanium oxide, or a white organic pigment selected from the group consisting of a urea-formaldehyde resin, a polystyrene resin, a polyethylene resin, and an acrylic resin.

11. A heat-sensitive recording paper as in claim 7, wherein the pigment has an average particle size of from 0.1 to 10 μm.

12. A heat-sensitive recording paper as in claim 7, wherein the paper support has a density of 0.83 g/cm$^3$ or more.

13. A heat-sensitive recording paper as in claim 1, wherein the paper support is formed from pulp which as a Canadian Standard Freeness of from 200 to 500 C.C.

14. A heat-sensitive recording paper as in claim 1, wherein the paper support is formed from pulp which has a Canadian Standard Freeness of from 300 to 400 C.C.

* * * * *